US005210721A

United States Patent [19]

Kikuchi

[11] Patent Number: 5,210,721

[45] Date of Patent: May 11, 1993

[54] ANALOG UNIVERSAL TIMEPIECE

[75] Inventor: Tadahiro Kikuchi, Tokyo, Japan

[73] Assignee: Orient Watch Co., Ltd., Tokyo, Japan

[21] Appl. No.: 829,238

[22] Filed: Feb. 3, 1992

[30] Foreign Application Priority Data

Feb. 4, 1991 [JP] Japan ..... 3-035553

[51] Int. Cl.[5] ..... G04B 19/22

[52] U.S. Cl. ..... 368/21; 368/27

[58] Field of Search ..... 368/21, 22, 27

[56] References Cited

U.S. PATENT DOCUMENTS

| | | | |
|---|---|---|---|
| 701,853 | 6/1902 | Davis . | |
| 2,456,122 | 12/1948 | Guilden | 368/27 |
| 3,318,085 | 5/1967 | Lee | 368/27 |
| 3,358,437 | 12/1967 | Burg | 368/27 |
| 3,675,411 | 7/1972 | Sakuma | 368/27 |
| 5,054,008 | 10/1992 | Darling | 368/27 |

FOREIGN PATENT DOCUMENTS

| | | |
|---|---|---|
| 64-34588 | 3/1989 | Japan . |
| 1-135384 | 9/1989 | Japan . |

*Primary Examiner*—Vit W. Miska

*Attorney, Agent, or Firm*—Pollock, Vande Sande & Priddy

[57] ABSTRACT

An analog universal watch has an area dial 4 showing different areas of the world attached to an area dial spindle 10 and an area dial wheel 11 linked to a timepiece drive mechanism through a minute wheel 15. A pawl fastened to an hour wheel 17 engages with a ratchet wheel 12 fastened to the area dial spindle 10 so that an hour hand spindle 16 is driven indirectly. Provisions are made to permit correcting the area dial spindle 10 by means of a hand setting stem through the minute wheel 15, along with the independent correction of the hour wheel 17 by means of the hour hand correcting wheel 25 that engages with and releases the hand setting stem. Thus, the timepiece permits not only the ordinary correction of the pointers but also the setting of the hour hand alone to the local time of the desired area.

3 Claims, 4 Drawing Sheets

ANALOG UNIVERSAL TIMEPIECE

BACKGROUND OF THE INVENTION

This invention relates to an analog universal timepiece, and more particularly to an analog universal timepiece with a unique hour hand correcting mechanism.

Many types of universal timepieces which show the time at main cities or in different areas of the world have been proposed.

In particular, portable universal watches are convenient for people traveling abroad to tell the difference between the local time of the place they are visiting and the corresponding time in their home country.

Digital universal timepieces show the times in two different places on the same display, either simultaneously or alternately. They are set to the local time by correcting the hour by means of a corrector switch.

In contrast, analog universal timepieces simultaneously show the time in a certain area of the world together with the times in other areas by means of a pointer and an area indicator carrying the names of such areas. The hour and minute hands of the analog universal timepieces are linked together through a train of gear wheels. To set to the time of a certain area, therefore, the minute hand must be turned many times until the hour hand shows the current hour in that area though the minute hand itself needs not to be corrected. This roundabout correction requires so much time that people often forget the current time during correction or fail to return the minute hand to its accurate position after correction. Some designs permit independent correction of the hour hand, but they do not allow the hour hand to be set in proper relation to the minute hand.

SUMMARY OF THE INVENTION

An object of this invention is to provide an analog universal timepiece that permits not only the normal time correction but also the independent setting of the hour hand to the standard time of the desired geographic area.

To achieve the above object, an analog universal timepiece according to this invention comprises an area dial wheel linked to a driving mechanism through a minute wheel train and an hour wheel linked to a time corrector through an hour correcting wheel, with the area dial wheel and hour wheel linked together through a one-way transmission.

Another object of this invention is to provide an analog universal timepiece that permits the normal time correction and the setting to the local standard time to be achieved by separate actions. To achieve this object, a timepiece according to this invention has a time corrector that can be displaced in two axial directions. While engaging with a minute wheel train in one axial direction, the time corrector also engages with an hour correcting wheel in the other.

Still another object of this invention is to provide an analog universal timepiece that keeps the one-way transmission intact even when the time corrector is turned in an inappropriate direction. To achieve this object, an idler that disengages from an hour correcting wheel on such occasion is provided between the time corrector and hour correcting wheel.

DESCRIPTION OF THE PREFERRED EMBODIMENTS

Figure 1:
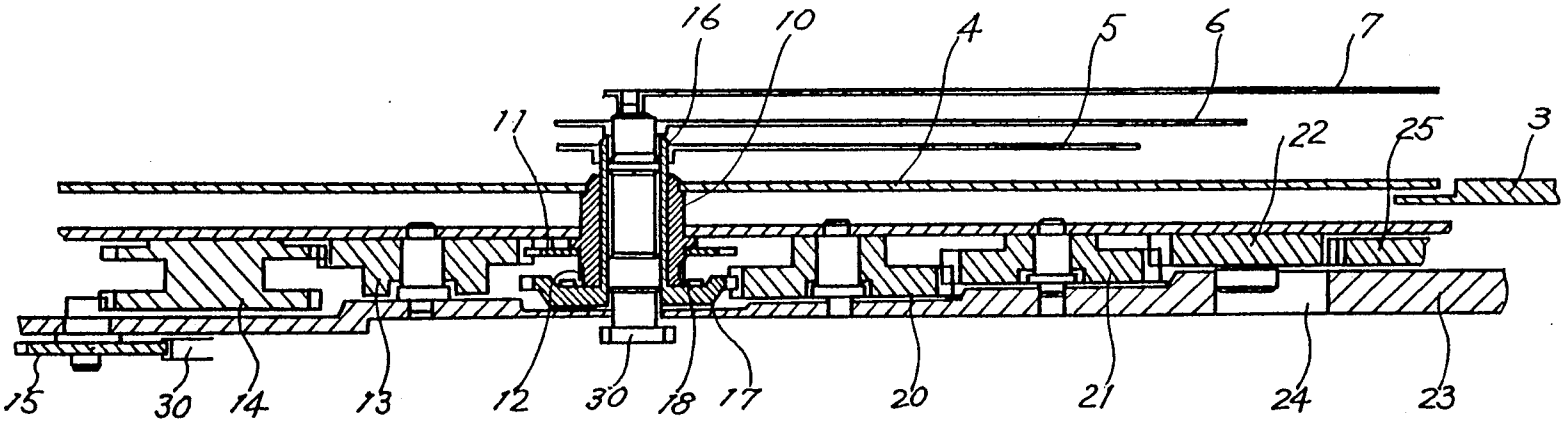
FIG. 1 shows a wheel train of an analog universal timepiece embodying the principle of this invention.
Figure 2:
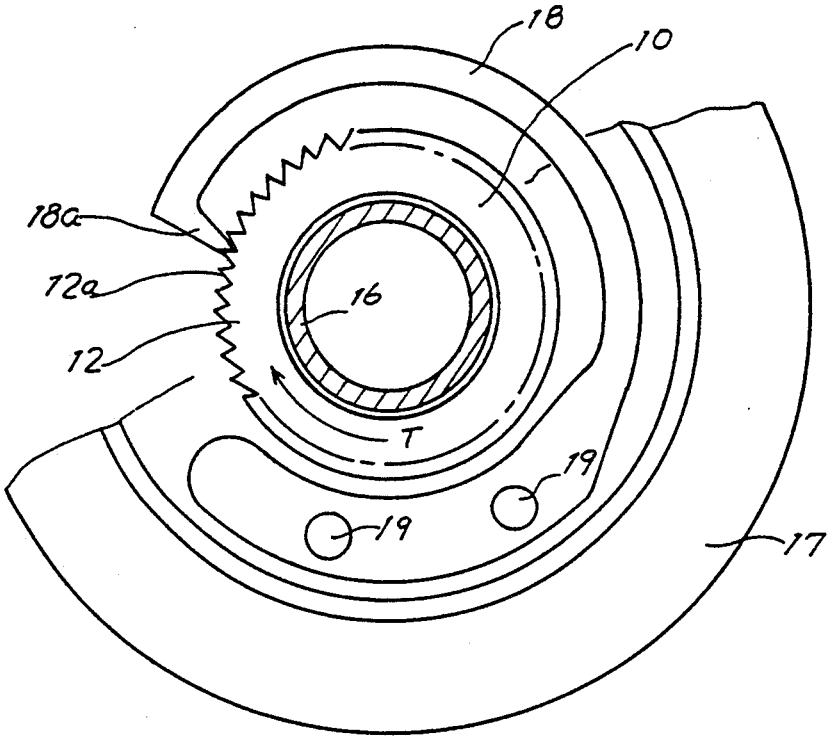
FIG. 2 is an enlarged view of a mechanism to link an area dial wheel with an hour wheel.

While FIG. 1 shows a wheel train of a universal watch according to this invention, FIG. 2 shows the principal parts thereof.

Figure 6:
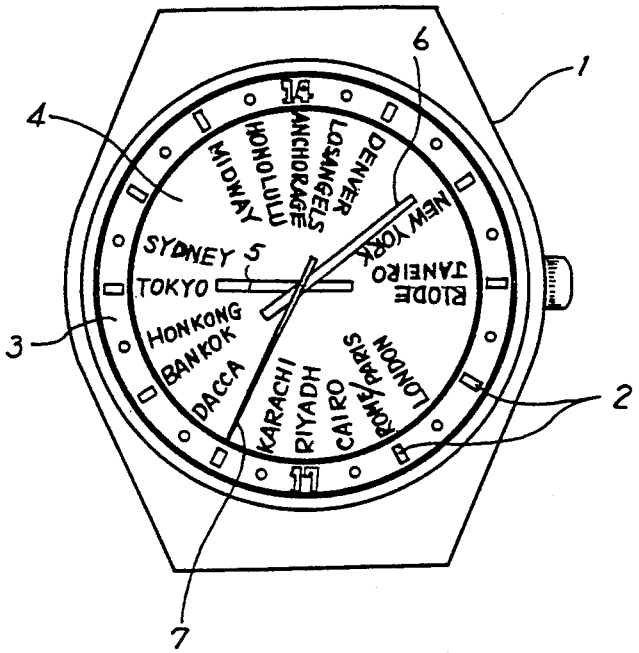
FIG. 6 is a plan view of an analog universal timepiece according to this invention.
Figure 7:
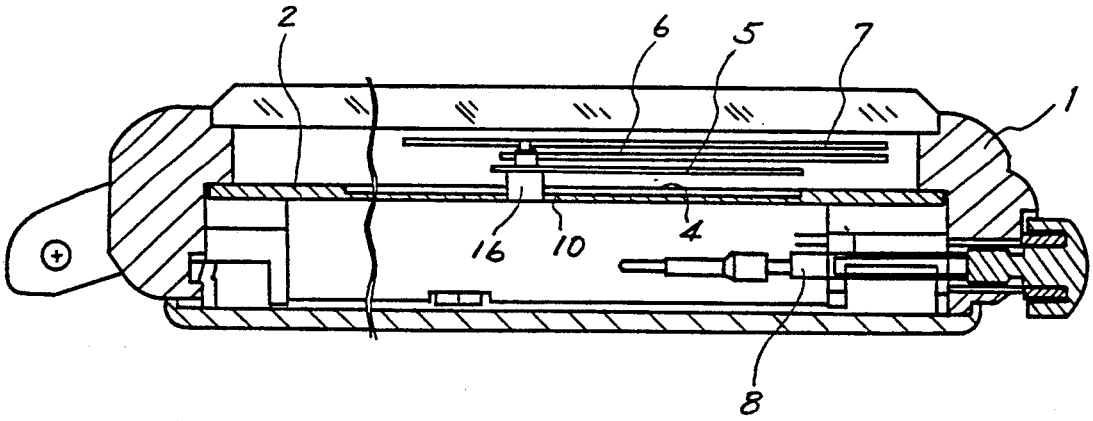
FIG. 7 is a cross-sectional side elevation of the same timepiece.

First, the outline of an analog universal timepiece according to this invention will be described by reference to FIGS. 6 and 7. A timepiece proper 1 comprises a dial 3 having twenty-four time graduations 2 on the periphery thereof, a geographic area dial 4 showing main cities of the world and fastened to an area dial spindle 10 that makes one complete rotation in twenty-four hours, an hour hand 5 mounted on an hour hand spindle 16 that rotates once in twenty-four hours, and a minute hand 6, a second hand 7 and a hand setting stem 8 of known types.

Referring now to FIGS. 1 and 2, reference numeral 10 designates an area dial spindle carrying an area dial 4 fastened to one end thereof. The area dial spindle 10 is rotatably fitted over the hour hand spindle 16 so that the two spindles can rotate independently. To the area dial spindle 10 is integrally attached an area dial wheel 11 that engages with a minute wheel 15 through two intermediate transmission wheels 13 and 14 and a ratchet wheel 12 having twenty-four teeth **12*a*** on the periphery thereof.

Engaged with a pawl 18 fastened to an hour wheel 17, the ratchet wheel 12 constitutes a click-type overrunning clutch mechanism that causes the hour hand spindle 16 to rotate clockwise while allowing only the hour hand spindle 16 to rotate clockwise when the hour is corrected.

On the other hand, the hour wheel 17 is integrally formed at one end of the hour hand spindle 16 that carries the hour hand 5 fastened to the other end thereof. The C-shaped pawl 18 is integrally fastened, with screws 19, inside the hour wheel 17 in such a manner as to surround the ratchet wheel 12. The catch **18*a* at the tip of the pawl 18 normally engages, because of its own elasticity, with one of the teeth 12*a* on the ratchet wheel 12**.

The hour wheel 17 engages with an hour hand correcting wheel 25 through two intermediate transmission wheels 20 and 21 and an oscillating wheel 22 described later. When a clockwise rotation-correcting force works on the hour wheel 17, the pawl 18 releases the tooth **12*a* on the ratchet wheel 12**, thus rotating clockwise on its own.

Figure 3:
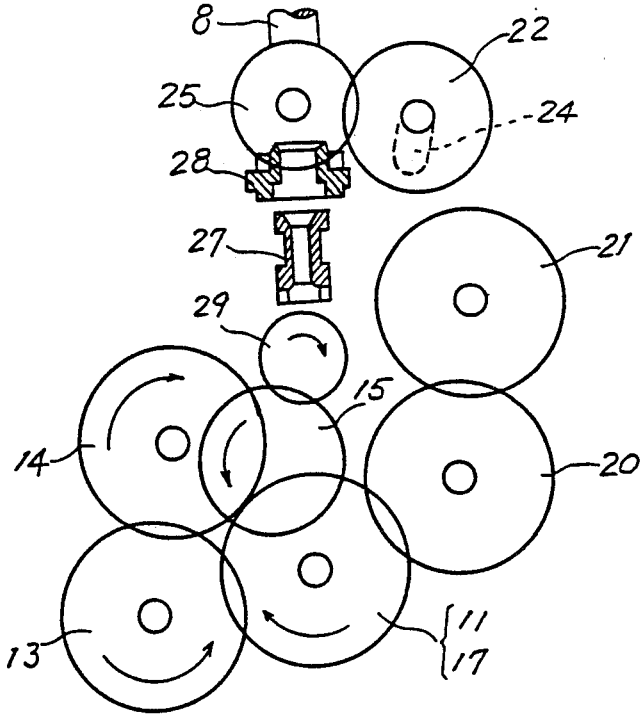
FIG. 3 shows a wheel train in a normal operating condition.

Engaging with the hour hand correcting wheel 25 as shown in FIG. 3, the oscillating wheel 22 is normally positioned, by the force applied by a spring not shown, at one end of a slot 24 provided in a base plate 23 and, thus, away from the intermediate transmission wheel 21. When the hour hand correcting wheel 25 is rotated clockwise, the oscillating wheel 22 comes into engagement with the intermediate transmission wheel 21, as shown in FIG. 4, to turn the hour wheel 17 clockwise.

Figure 4:
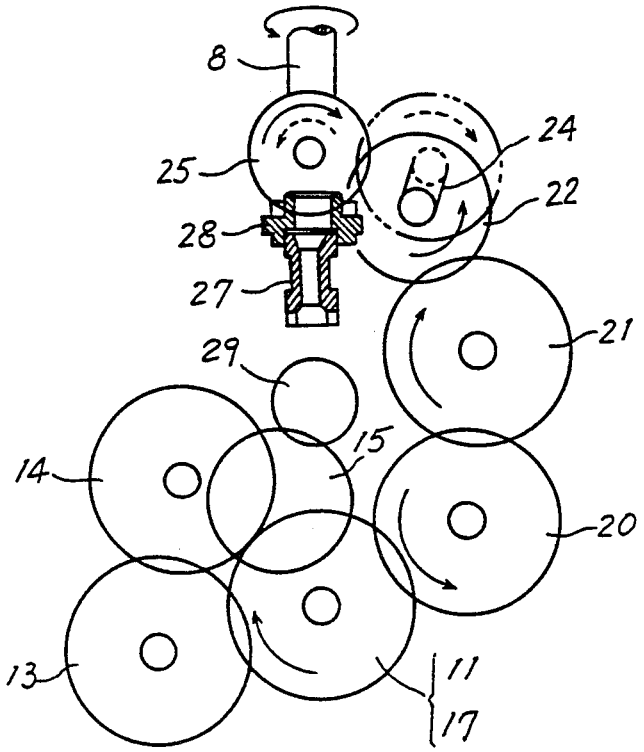
FIG. 4 shows a wheel train in an hour hand correcting condition.
Figure 5:
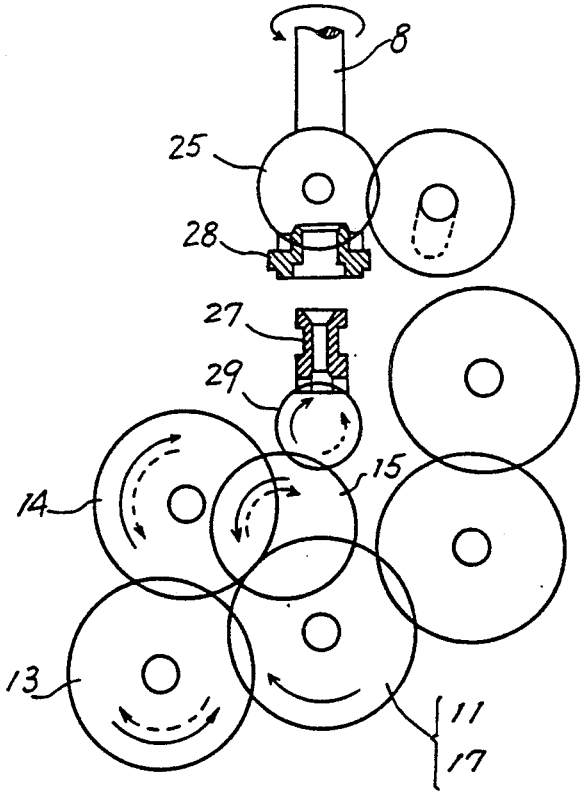
FIG. 5 shows a wheel train in a pointer correcting condition.

FIGS. 3 to 5 show a mechanism to correct the pointer and the like. A sliding pinion 27 shown in the figures is of known type that is slidably attached to the square part of a hand setting stem 8.

When the hand setting stem 8 is pulled one step, the sliding pinion 27 engages with the hour hand correcting wheel 25 mentioned before through a toothed crown wheel 28, as shown in FIG. 4, to correct the hour hand 5. When the hand setting stem 8 is pulled two steps, the sliding pinion 27 engages with the minute wheel 15 through a setting wheel 29, as shown in FIG. 5, to correct the minute hand 6 and the area dial 4.

Reference numeral 30 in FIG. 4 designates a minute hand pinion.

The following paragraphs describe how the analog universal timepiece of this invention shows and corrects the time by reference to FIGS. 3 to 5.

FIG. 3 shows the timepiece in a normal state, with the crown pressed in position. In this state, the driving force from a rotary pinion, not shown, is transmitted through the minute hand pinion 30 to the minute wheel 15, and further through the intermediate transmission wheels 14 and 13 to the area dial wheel 11 engaging therewith, thereby causing the area dial 4 on the area dial spindle 10 to rotate once in twenty-four hours. Thus the standard time in a given area can be read from a combination of the city names on the area dial and the time graduations 2 on the dial 3. At the same time, the ratchet wheel 12 on the area dial spindle 10 transmits the rotational motion to the hour hand spindle 16 through the pawl 18 engaging with one of the teeth 12*a* thereon. Then, for example, the hour hand 5 pointing at "TOKYO" on the area dial 4, as shown in FIG. 6, shows the current time in Tokyo.

To set the timepiece to the local time of a different place, as required when visiting a foreign country, the crown on the hand setting stem 8 must be pulled one step.

Then, a setting lever and other switching mechanism bring the sliding pinion 27 into engagement with the hour hand correcting wheel 25, as shown in FIG. 4. When the hand setting stem 8 in this state is turned in the direction of the arrow, the hour hand correcting wheel 25 rotates in the direction of the solid arrow or clockwise, thus moving the oscillating wheel 22 engaging therewith downward in the slot 24 to engage with the intermediate transmission wheel 21, rotating the intermediate transmission wheels 21 and 20 in the directions of the arrows shown thereon, and rotating the hour wheel 17 clockwise. As a consequence, the pawl 18 moves over the teeth 12*a* on the ratchet wheel 12 without engaging therewith, thereby rotating only the hour wheel 17 clockwise and thus moving the integral hour hand 5 to the desired city on the area dial 4 which indicates the standard time of that area.

Even while the hour hand is thus being corrected, the area dial wheel 11 continues to rotate, by the rotational force transmitted from the minute wheel 15, at a speed ratio of 24:1 with respect to the minute hand 6. Even if the hour hand 5 is not properly positioned in relation to the minute hand 6 immediately after the correction, the pawl 18 comes into engagement again with the teeth 12*a* on the ratchet wheel 12 as time passes, thus bringing the hour hand 5 into a proper position relative to the minute hand 6. If the current time is 1530 hours, for example, the hour hand is correctly positioned midway between 1500 hours and 1600 hours.

If the hand setting stem 8 is turned in the opposite direction, the hour hand correcting wheel 25 rotates in the direction of the dashed arrow in FIG. 4, thus moving the oscillating wheel 22 upward in the slot 24 to release the intermediate transmission wheel 21. Therefore, the hour wheel 17 and area dial wheel 11 are prevented from turning counterclockwise.

To correct the pointer after replacing a dead power cell or to reset the time, the hand setting stem 8 is pulled one more step as shown in FIG. 5. Then, the setting level causes the sliding pinion 27 to engage with the setting wheel 29. When the hand setting stem 8 is turned in the direction of the arrow, the setting wheel 29, the minute wheel 15 and the intermediate transmission wheels 14 and 13 are rotated in the directions of the solid arrows shown thereon, thus transmitting the clockwise rotation to the minute hand 6 and the area dial wheel 11 and turning the hour wheel 17 clockwise through the pawl 18 engaging with the ratchet wheel 12. Thus, resetting to the correct current time is completed.

To set the area dial wheel 11 to the summer time of a foreign country, the area dial 4 is put forward one hour by turning the hand setting stem 8 clockwise after pulling two steps. Then, the hand setting stem 8 is pushed back one step to set the hour hand 5 alone back to the original time.

To reset the area dial wheel 11 from the summer time to the original time, the area dial wheel 11 is put backward one hour by turning the hand setting stem 8 counterclockwise after pulling two steps and, thus, turning the setting wheel 29 and other wheels in the directions of the dashed arrows shown thereon. Then, the hour hand 5 continues to show the current time as the pawl 18 moves over the teeth 12*a* on the ratchet wheel 12 without engaging therewith.

To allow independent correction of the hour wheel 17, the preferred embodiment just described is equipped with the click-type overrunning clutch mechanism comprising the ratchet wheel 12 and pawl 18. Other overrunning clutches of known types, which have a ball or a wedge interposed between types, driving area dial spindle 10 and the driven hour hand spindle 16, also serve the same purpose.

Though the area dial 4 and hour hand 5 of the preferred embodiment are desinged to make one complete rotation in twenty-four hours, they may also be designed to make one rotation in twelve hours as those of ordinary timepieces. To do so, the area dial 4 may be made of a liquid crystal display that alternately shows the areas in the western and eastern hemispheres in each turn. While the preferred embodiment described here is a portable electronic watch, the principle of this invention is also applicable to clocks and mechanically operated watches.

What is claimed is:

1. An analog universal watch comprising:

a minute wheel for rotating a minute hand spindle supporting a minute hand;

an hour wheel for rotating an hour hand spindle supporting an hour hand;

a geographic area dial wheel for rotating a geographic area dial spindle which supports a geographic area dial which indicates different geographic time zones;

a minute wheel transmission coupling said minute wheel to said geographic area dial wheel;

a clutch mechanism coupling said hour wheel with said geographic area dial wheel which rotates said hour wheel in one direction, and permits said hour wheel to be advanced in said one direction with respect to said geographic area dial wheel;

an hour correcting wheel coupled to said hour wheel through an idler gear, said idler gear rotating said hour wheel in only said one direction; and, a time correcting means which rotates said idler wheel into engagement with said hour correction wheel, whereby said hour hand is advanced in said one direction.

2. An analog universal watch according to claim 1, in which the clutch mechanism comprises a click-type overrunning mechanism comprising a ratchet wheel fastened to said geographical area dial spindle and having as many teeth as the number of hours on the periphery thereof, and a pawl fastened to said hour hand spindle and engaging with the teeth on the ratchet wheel.

3. An analog universal watch according to claim 1, in which the time correcting means includes a manually operated control member, movable between multiple axial positions, that engages with the hour correcting wheel in one axial position and engages the minute wheel transmission in another axial position.

* * * * *